US007520234B1

(12) United States Patent
McKinney

(10) Patent No.: US 7,520,234 B1
(45) Date of Patent: Apr. 21, 2009

(54) EXTENDED MOTOR FLUSH MUFF HANDLE DEVICE

(76) Inventor: Palmer McKinney, 138 SE. 31st Ter., Cape Coral, FL (US) 33904

( * ) Notice: Subject to any disclaimer, the term of this patent is extended or adjusted under 35 U.S.C. 154(b) by 0 days.

(21) Appl. No.: 12/017,012

(22) Filed: Jan. 19, 2008

(51) Int. Cl.
*B63B 21/12* (2006.01)

(52) U.S. Cl. ..... 114/221 R; 294/19.1

(58) Field of Classification Search ..... 114/221 R; 294/19.1, 24, 106, 119.2
See application file for complete search history.

(56) References Cited

U.S. PATENT DOCUMENTS 3,219,376 A * 11/1965 Peters ..... 294/19.1
3,502,112 A * 3/1970 Hankila ..... 138/99
4,741,283 A * 5/1988 Conner ..... 114/230.3
4,834,437 A * 5/1989 Howard, Sr. ..... 294/19.1
5,154,131 A * 10/1992 Hall ..... 114/230.3

* cited by examiner

*Primary Examiner*—Stephen Avila

(57) ABSTRACT

An extended motor flush muff handle device that is constructed of an outer clamp tube, an inner clamp tube, an extended hollow tube connecting the inner clamp tube with a pivotally operated handle such that an outboard marine engine can be flushed remotely by a boat owner on either side of the dock where the boat is docket.

3 Claims, 4 Drawing Sheets

EXTENDED MOTOR FLUSH MUFF HANDLE DEVICE

FIELD OF THE INVENTION

The present invention generally relates to a boating accessory and more particularly, relates to an extended motor flush muff handle device for flushing out outboard engines.

BACKGROUND OF THE INVENTION

Boating is one of the most popular water sports in this country. It is especially popular in the various states that are bordering the Atlantic and Pacific, or any of the stated that is populated with inland lakes. When a boat with an outboard engine is used, after each use of the boat the outboard engine must be flushed out of any salt or other containments left in the engine in order to avoid rusting or other malfunction of the engine. The flushing process is necessary in order to protect against corrosion build-up and to maintain the condition of an expensive marine engine. The flushing process further reduces the potential for damage and repairs, thus saving the boat owner a significant amount of time, effort, and money. However, the flushing process for removing salt and other foreign materials from the outboard marine engines can be an awkward task in that the boat owner must stand on his head under the boat to perform the flushing. It is therefore desirable to provide a tool that can be easily used for facilitating the engine flushing process for a boat owner to use.

It is therefore an object of the present invention to provide an extended motor flush muff handle device for use by a boat owner to flush out an outboard marine engine.

SUMMARY OF THE INVENTION

In accordance with the present invention, an extended motor flush muff handle device for flushing out an outboard marine engine by a boat owner is provided.

In a preferred embodiment, the present invention extended motor flush muff handle device can be constructed by an outer clamp tube of at least 4 feet length and has a C-cross-section and an aperture at a center of the length in fluid communication with a cavity of a first end of an extended hollow tube; an inner clamp tube of annular cross-section split in two halves along a longitudinal direction, the two halves hingedly operable to open or close in a clam-shell manner when a spring hinge is released or pulled, respectively; the two halves are adapted for clamping a flush muff of a boat engine wherein when the spring hinge is pulled by a first end of a cable threaded through the extended hollow tube; and a handle pivotally operable on a base with a second end of the extended hollow tube mounted on the base for pulling a second end of the cable when the handle is pivotally pulled to close the two halves of the inner clamp tube so as to clamp onto the flush muff.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses an extended motor flush muff handle device for flushing out an outboard marine engine.

The present invention device is a tool for assisting with removal of salt and other foreign material from outboard marine engines. It greatly simplifies the process of flushing salt, dirt, and debris from the engine while the boat is docket. This saves time and effort for the boat owner while also protecting the expensive outboard marine engine from potential harm.

The present invention device of an elongated plastic tool measures about 4 to 6 feet long and of the tool is a T-shaped with a tubular shape that includes any broad opening along the length of the outer edge. The opposite end is rounded with a special clamp that has a pivotally operated handle. The clamp measures about 4 to 6 inches long, or just long enough to hold the muff stable for flushing installation. When the outboard marine engine required flushing of contaminants at the dock, the present invention device can simply be utilized. An individual would attach the clamp tool handle from either side of the muff from the dock with ease. The boat owner could then proceed to flush out the residue from the motor without stand on his head under the boat. The present invention device helps to flush the system in a simple, convenient and comfortable manner so the engine is properly protected and maintained.

The present invention extended motor flush muff handle device fulfills the need for easier flushing of salt and contaminants from outboard engines. The appealing features of the present invention device are its ease of use, protection, and trouble-free boating. Instead of rust and scale forming within the outboard engine, the present invention product helps to flush out salt and containments. This protects against corrosion build-up to maintain the condition of the expensive marine engine. It further reduces the potential for damage and repairs, thus saving boat owner a significant amount of time, effort, and money. The present device provides peace of mind for concerned outboard owners while helping to assure trouble-free boating. The lightweight and easy to use device can replace various homemade products often used by desperate boaters. It saves significant time and effort for a boat owner and without the hassle and potential danger of standing on his head under the boat. In addition, the product is reliable, affordable, and corrosion resistant.

Figure 1:
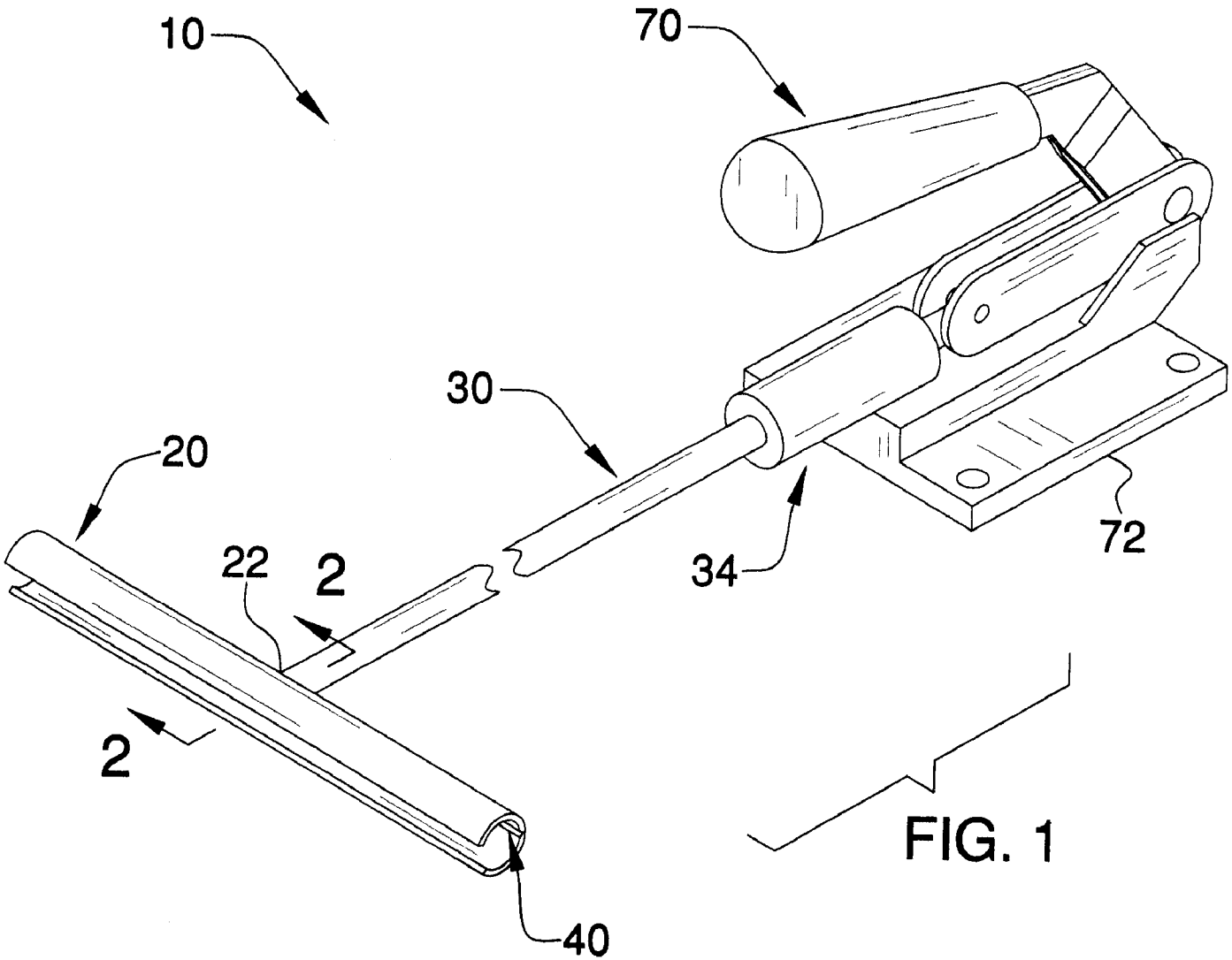
FIG. 1 is a perspective view of the present invention extended motor flush muff handle device.
Figure 2A:
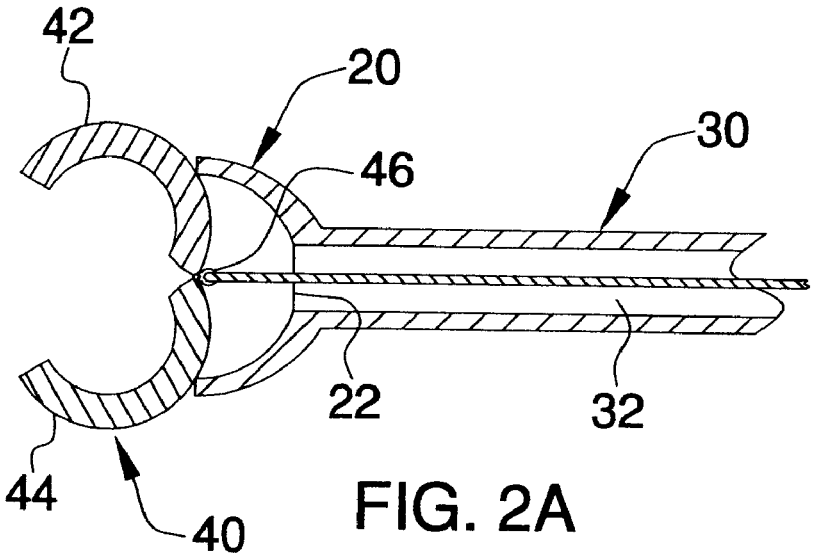
FIG. 2A is a partial, cross-sectional view of the inner and outer clamp tube with the inner clamp tube in an open position.
Figure 2B:
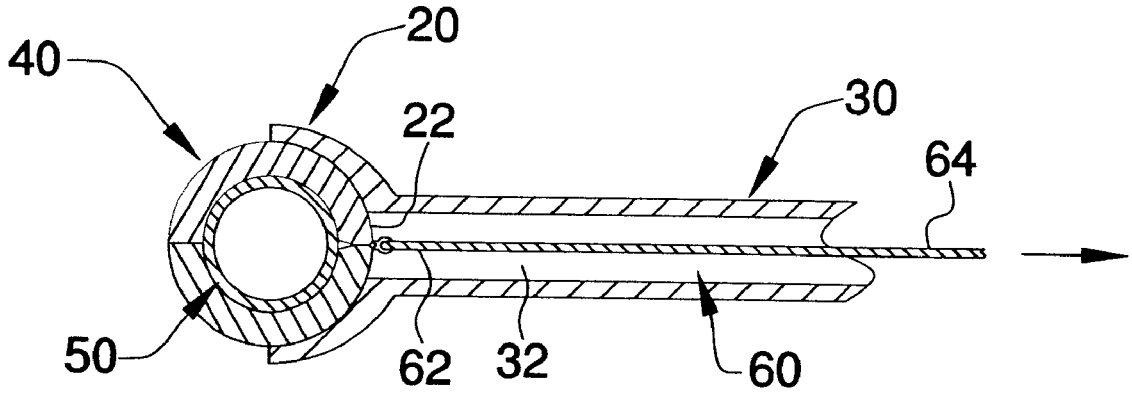
FIG. 2B is a partial, cross-sectional view illustrating the inner and outer clamp tube with the inner clamp tube in a closed position.
Figure 3:
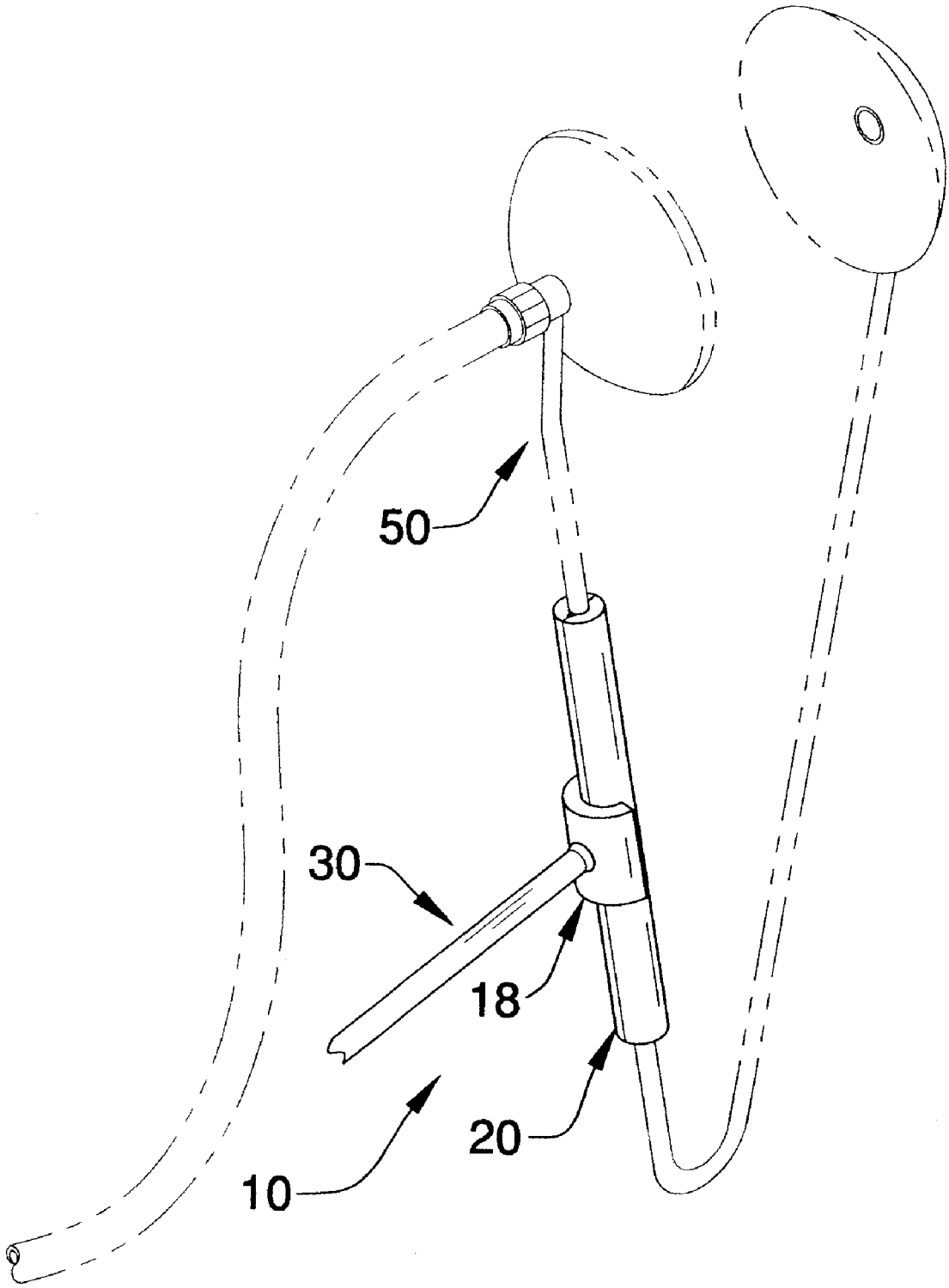
FIG. 3 is a perspective view of the present invention device engaging a flush muff.

Referring initially to FIG. 1, wherein a perspective view of the present invention extended motor flush muff handle device 10 is shown. The extended motor flush muff handle device 10 is constructed of an outer clamp tube 20, better shown in FIGS. 2A, 2B of at least 4 inch length, and preferably about 6 inch length, each has a C-cross-section and an aperture 22 at a center of the length in fluid communication with a cavity 32 of a first end of an extended hollow tube 30. The present invention further includes an inner clamp tube 40 of annular rust-section that is split in two halves 42, 44 along a longitudinal direction. The two halves 42, 44 hingedly operable to open or close in a clam-shell manner when a spring hinge 46, which keeps the two halves 42,44 in a normal-open position, is released or pulled, respectively. The two halves 42,44 are adapted for clamping a flush muff 50 of a boat engine therein when the spring hinge 46 is pulled by a first end 62 of a cable 60 threaded through the cavity 32 of the hollow tube 30. It is to be noted that, in FIG. 3, an adapted piece 18 is also shown for connecting the extended hollow tube 30 to the outer clamp tube 20.

The present invention further includes a handle 70 pivotally operable on a base 72 with a second end 34 of the extended hollow tube 30 mounted on the base 72 for pulling a second end 64 of the cable 60 when the handle 70 is pivotally pulled to close the two halves 42,44 of the inner clamp tube 40 so as to clamp onto the flush muff 50.

Figure 4:
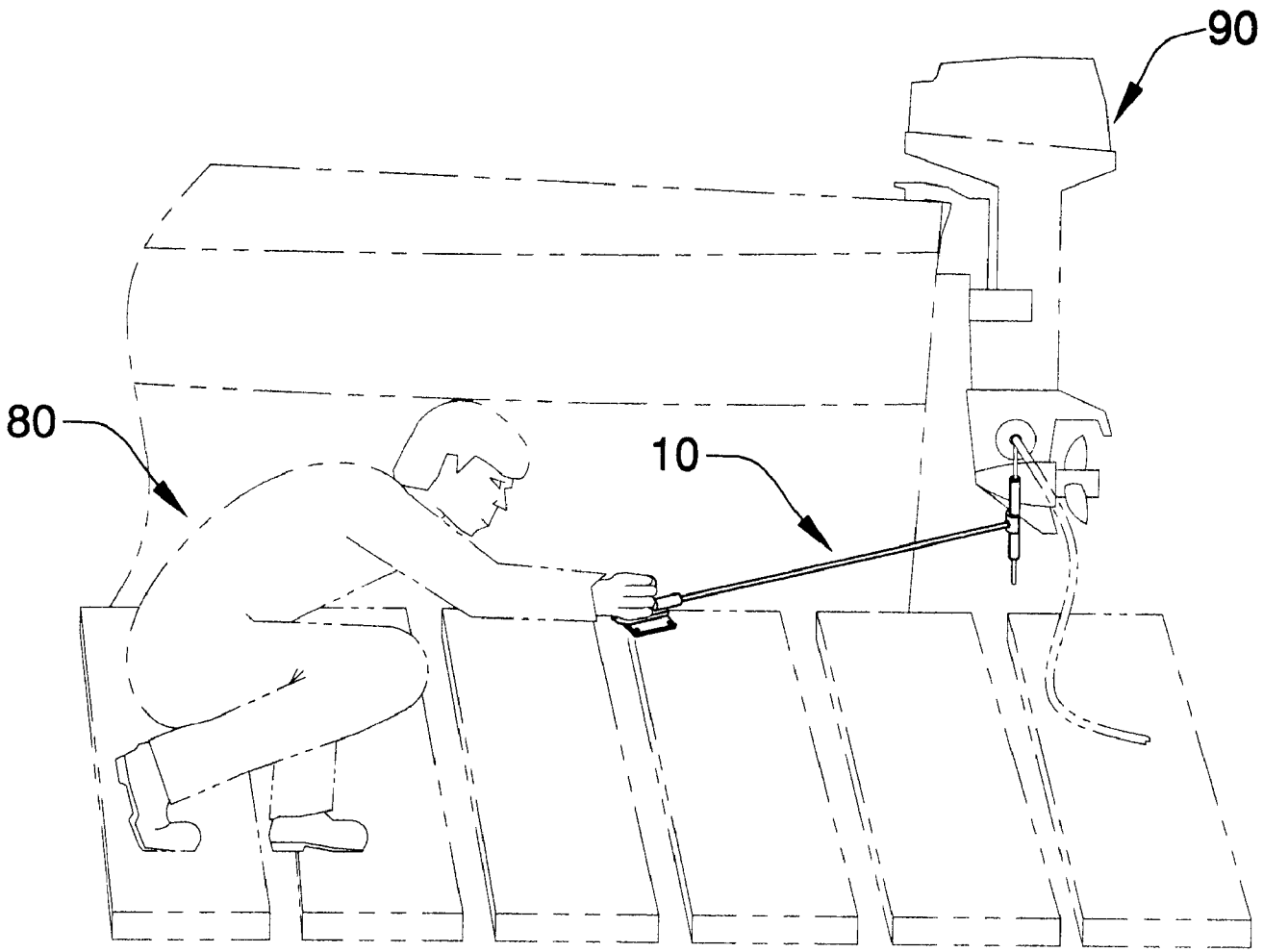
FIG. 4 is another perspective view illustrating the application of the present invention device.

The application of the present invention device 10 by a boat owner is further shown in FIG. 4 for cleaning an outboard marine engine 90.

The present invention extended motor flush muff handle device has therefore been amply described in the above descriptions and in the appended drawings of FIGS. 1-4.

While the preferred embodiments of the invention have been described above, it will be recognized and understood that various modifications can be made in the invention and the appended claims are intended to cover all such modifications which may fall within the spirit and scope of the invention.

What is claimed is:

1. A extended motor flush muff handle device comprising:

an outer clamp tube having a length between about 4 inches and about 6 inches and a C-cross-section and an aperture at a center of said length in fluid communication with a cavity of a first end of an extended hollow tube;

an inner clamp tube of annular cross-section split in two halves along a longitudinal direction, said two halves hingedly operable to open or close in a clam-shell manner when a spring hinge is released or pulled, respectively; said two halves are adapted for clamping a flush muff of a boat engine therein when said spring hinge is pulled by a first end of a cable threaded through said extended hollow tube; and a handle pivotally operable on a base with a second end of said extended hollow tube mounted on said base for pulling a second end of said cable when said handle is pivotally pulled to close said two halves of said inner clamp tube so as to clamp onto the flush muff.

2. The extended motor flush muff handle device according to claim 1, wherein said outer clamp tube, said inner clamp tube, said extended hollow tube and said handle and base are fabricated in a plastic material.

3. The extended motor flush muff handle device according to claim 1, wherein said extended hollow tube has a length between about 4 feet about 6 feet.

* * * * *